US011702869B2

(12) United States Patent
Ney

(10) Patent No.: US 11,702,869 B2
(45) Date of Patent: Jul. 18, 2023

(54) VEHICLE LATCH ASSEMBLY WITH INTERCHANGEABLE POWER RELEASE GEARS FOR NORMAL OR HIGH OUTPUT LATCH SYSTEMS

(71) Applicant: Inteva Products, LLC, Troy, MI (US)

(72) Inventor: Daniel Alexander Ney, Lake Orion, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 317 days.

(21) Appl. No.: 16/852,438

(22) Filed: Apr. 18, 2020

(65) Prior Publication Data

US 2020/0332571 A1 Oct. 22, 2020

Related U.S. Application Data

(60) Provisional application No. 62/836,032, filed on Apr. 18, 2019.

(51) Int. Cl.
*E05B 81/34* (2014.01)
*E05B 81/42* (2014.01)
(Continued)

(52) U.S. Cl.
CPC ..... *E05B 81/34* (2013.01); *E05B 81/20* (2013.01); *E05B 81/42* (2013.01); *E05B 83/36* (2013.01);
(Continued)

(58) Field of Classification Search
CPC ..... E05B 81/00; E05B 17/0029; E05B 81/34; E05B 81/20; E05B 81/42; E05B 83/36;
(Continued)

(56) References Cited

U.S. PATENT DOCUMENTS 4,885,954 A * 12/1989 Wanlass ..... E05B 81/25 292/201
5,169,186 A * 12/1992 Fukumoto ..... E05B 81/16 292/201
(Continued)

FOREIGN PATENT DOCUMENTS

DE 102013020423 A1 * 6/2015 ..... B60R 16/03
EP 1460215 A2 * 9/2004 ..... E05C 9/023
(Continued)

OTHER PUBLICATIONS

International Preliminary Report on Patentability for International Application No. PCT/US2020/028879; International Filing Date: Apr. 18, 2020; dated Sep. 28, 2021; 5 pages.
(Continued)

*Primary Examiner* — Kristina R Fulton
*Assistant Examiner* — Emily G. Brown
(74) *Attorney, Agent, or Firm* — Cantor Colburn LLP

(57) ABSTRACT

A latching assembly providing two options or systems for electric release output and timing, while keeping the two systems as common with one another as possible. A vehicle latching assembly, including: a housing; a release lever pivotally mounted to the housing; a first gear train for actuating the release lever, the first gear train includes a first worm and a first release gear the first worm meshingly engages the first release gear; and a second gear train for actuating the release lever, the second gear train being interchangeable with the first gear train, the second gear train includes a second worm and a second release gear the second worm meshingly engages the second release gear, wherein the second gear train applies a greater amount of force to the release lever than the first gear train.

14 Claims, 6 Drawing Sheets

(51) Int. Cl.
*E05B 81/20* (2014.01)
*E05B 83/36* (2014.01)

(52) U.S. Cl.
CPC ... *E05Y 2201/702* (2013.01); *E05Y 2900/531* (2013.01)

(58) Field of Classification Search
CPC ..... E05B 63/0056; E05B 81/06; E05B 81/14; E05C 9/023; E05C 9/10; E05C 53/008; E05C 3/36; E05C 9/12
See application file for complete search history.

(56) References Cited

U.S. PATENT DOCUMENTS

| | | | | |
|---|---|---|---|---|
| 6,102,453 | A * | 8/2000 | Cetnar | E05B 81/06 292/201 |
| 11,248,402 | B2 * | 2/2022 | Faitl | E05B 81/34 |
| 2002/0111241 | A1 * | 8/2002 | Kujira | F16H 37/041 475/149 |
| 2005/0052032 | A1 * | 3/2005 | Ilea | E05B 81/25 292/216 |
| 2006/0103143 | A1 * | 5/2006 | Belmond | E05B 81/06 292/201 |
| 2007/0126242 | A1 * | 6/2007 | Adrian-Gulpinarli | E05B 63/0056 292/201 |
| 2016/0003331 | A1 * | 1/2016 | Topfer | E05B 81/30 74/516 |
| 2016/0245000 | A1 | 8/2016 | Ottino et al. | |
| 2021/0198924 | A1 | 7/2021 | Faitl | |

FOREIGN PATENT DOCUMENTS

| | | | | |
|---|---|---|---|---|
| EP | 1590547 | B1 * | 7/2008 | E05B 63/0056 |
| EP | 1671003 | B1 | 12/2016 | |
| JP | 5135642 | B2 | 2/2013 | |
| WO | 2017116032 | A1 | 7/2017 | |
| WO | 2017133717 | A2 | 8/2017 | |

OTHER PUBLICATIONS

International Search Report for Application No. PCT/US2020/028879; dated Jul. 30, 2020.
Written Opinion for Application No. PCT/US2020/028879; dated Jul. 30, 2020.
Supplementary EP Search Report; EP Application No. EP 20790661; Date of Completion of Search Nov. 9, 2022; 2 pages.
Written Opinion for EP Application No. 20790661.1; dated Nov. 9, 2022; 2 pages.

* cited by examiner

VEHICLE LATCH ASSEMBLY WITH INTERCHANGEABLE POWER RELEASE GEARS FOR NORMAL OR HIGH OUTPUT LATCH SYSTEMS

CROSS REFERENCE TO RELATED APPLICATIONS

This application claims the benefit of U.S. Provisional Application Ser. No. 62/836,032 filed on Apr. 18, 2019, the contents of which are incorporated herein by reference thereto.

BACKGROUND

Exemplary embodiments of the present disclosure pertain to the art of vehicle latches.

For a family of latching systems, there are typically many different requirements that can vary from customer to customer or even door to door. A common practice with electric release systems is to have an emergency inside handle to release the door post-crash or in the event of a power loss to the vehicle. However, many original equipment manufacturers (OEMs) are only using a handle on the front door of the vehicle and using a power back up system for the rear doors. This means that the rear door must be able to electrically release during very high seal loads, while the front door does not. In order to keep as many things common with the designs as possible, the ideal situation would be to use the same electric release system on the front door as the rear, however, with the additional output required to release the high seal loads for the rear door, the time to release increases significantly (due to larger gear train). This may be undesirable for the front door, or may not even be required be certain vehicles or customers, so two latching systems would be ideal to meet each need. However, designing multiple platforms can get expensive as additional tooling is required.

BRIEF DESCRIPTION

A latching assembly providing two options or systems for electric release output and timing, while keeping the two systems as common with one another as possible.

Disclosed is a vehicle latching assembly, including: a housing; a release lever pivotally mounted to the housing; a first gear train for actuating the release lever, the first gear train includes a first worm and a first release gear the first worm meshingly engages the first release gear; and a second gear train for actuating the release lever, the second gear train being interchangeable with the first gear train, the second gear train includes a second worm and a second release gear the second worm meshingly engages the second release gear, wherein the second gear train applies a greater amount of force to the release lever than the first gear train.

In addition to one or more of the features described above, or as an alternative to any of the foregoing embodiments, a diameter of the first release gear is the same as a diameter of the second release gear.

In addition to one or more of the features described above, or as an alternative to any of the foregoing embodiments, the first worm is a left handed 1-lead worm.

In addition to one or more of the features described above, or as an alternative to any of the foregoing embodiments, the second worm is a right handed 2-lead worm.

In addition to one or more of the features described above, or as an alternative to any of the foregoing embodiments, the first worm is configured to rotate the first release gear at a speed that is greater than a speed which the second worm rotates the second release gear.

In addition to one or more of the features described above, or as an alternative to any of the foregoing embodiments, the vehicle latching assembly is configured for use as a forward vehicle door latching assembly when the first gear train is located in the vehicle latching assembly.

In addition to one or more of the features described above, or as an alternative to any of the foregoing embodiments, the vehicle latching assembly is configured for use as a rear vehicle door latching assembly when the second gear train is located in the vehicle latching assembly.

In addition to one or more of the features described above, or as an alternative to any of the foregoing embodiments, a motor is provided for driving the first worm or the second worm.

In addition to one or more of the features described above, or as an alternative to any of the foregoing embodiments, the first gear train includes a motor.

In addition to one or more of the features described above, or as an alternative to any of the foregoing embodiments, the second gear train includes a motor.

In addition to one or more of the features described above, or as an alternative to any of the foregoing embodiments, an axis of rotation of the first worm is separated from an axis of rotation of the first release gear by a distance that is equal to a distance that separates an axis of rotation of the second worm from an axis of rotation of the second release gear.

In addition to one or more of the features described above, or as an alternative to any of the foregoing embodiments, the first release gear and the second release gear each have a cam profile configured to contact a cam profile of the release lever.

In addition to one or more of the features described above, or as an alternative to any of the foregoing embodiments, a diameter of the first release gear is the same as a diameter of the second release gear and the first worm is a left handed 1-lead worm and the second worm is a right handed 2-lead worm.

In addition to one or more of the features described above, or as an alternative to any of the foregoing embodiments, an axis of rotation of the first worm is separated from an axis of rotation of the first release gear by a distance that is equal to a distance that separates an axis of rotation of the second worm from an axis of rotation of the second release gear.

In addition to one or more of the features described above, or as an alternative to any of the foregoing embodiments, the first worm is opposite handed with respect to the second worm.

In addition to one or more of the features described above, or as an alternative to any of the foregoing embodiments, the first worm is a left handed 1-lead worm and the second worm is a right handed 2-lead worm.

In addition to one or more of the features described above, or as an alternative to any of the foregoing embodiments, the vehicle latching assembly is configured for use as a vehicle door latching assembly that does not employ a user operated mechanical handle to release the latch when the second gear train is located in the vehicle latching assembly.

In addition to one or more of the features described above, or as an alternative to any of the foregoing embodiments, a diameter of the first release gear is the same as a diameter of the second release gear and the first worm is opposite handed with respect to the second worm.

In addition to one or more of the features described above, or as an alternative to any of the foregoing embodiments, an axis of rotation of the first worm is separated from an axis of rotation of the first release gear by a distance that is equal to a distance that separates an axis of rotation of the second worm from an axis of rotation of the second release gear and the first worm is a 1-lead worm and the second worm is a 2-lead worm.

Also disclosed is a method for providing either a vehicle latching assembly for either a front door or a rear door, including: installing either a first gear train or a second gear train into a housing of the vehicle latching assembly for actuating a release lever of the vehicle latching assembly, the first gear train includes a first worm and a first release gear the first worm meshingly engages the first release gear, and the second gear train includes a second worm and a second release gear the second worm meshingly engages the second release gear, wherein the second gear train applies a greater amount of force to the release lever than the first gear train.

In addition to one or more of the features described above, or as an alternative to any of the foregoing embodiments, a diameter of the first release gear is the same as a diameter of the second release gear.

In addition to one or more of the features described above, or as an alternative to any of the foregoing embodiments, the first worm is a left handed 1-lead worm.

In addition to one or more of the features described above, or as an alternative to any of the foregoing embodiments, the second worm is a right handed 2-lead worm.

In addition to one or more of the features described above, or as an alternative to any of the foregoing embodiments, the first worm is configured to rotate the first release gear at a speed that is greater than a speed which the second worm rotates the second release gear.

In addition to one or more of the features described above, or as an alternative to any of the foregoing embodiments, the first gear train and the second gear train includes a motor.

In addition to one or more of the features described above, or as an alternative to any of the foregoing embodiments, the first worm is a left handed 1-lead worm.

In addition to one or more of the features described above, or as an alternative to any of the foregoing embodiments, the second worm is a right handed 2-lead worm.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The latching assembly disclosed herein is designed to allow for a more versatile and cost effective way of providing two options for electric release output and timing, while keeping the two systems as common with one another as possible. This design allows for one latch assembly design to be made, with the only variation between the two being the worm and the release gear. By fine tuning the gear trains, the two designs can be made to have a common center and approximately the same outside diameters for packaging requirements. In doing this one gear train can be designed to have very high output, while being a little bit slower, and the other can be designed for a more conventional system with balanced speed and output.

One way of achieving this is to have one of the designs use a 1-lead worm and the other to use a 2-lead worm. The systems will have roughly the same packaging sizes, and close to the same number of teeth, but the gear ratio on the 2-lead worm and gear will be close to double the output of the 1-lead worm, while the 1-lead worm will be close to double the speed of the other. This allows for 1 system design to be able to have two power release options without having to change any components internal to the latch other that the worm and worm gear. The release cam profile will remain common on both gears as well as stack up's and pivot size, so they truly are interchangeable.

Also and in order to ensure that there are no issues with manufacturing, the 1-lead gear train in one embodiment will be opposite handed of the 2-lead gear train, which will guarantee that they cannot be misassembled to one another.

Figure 1:
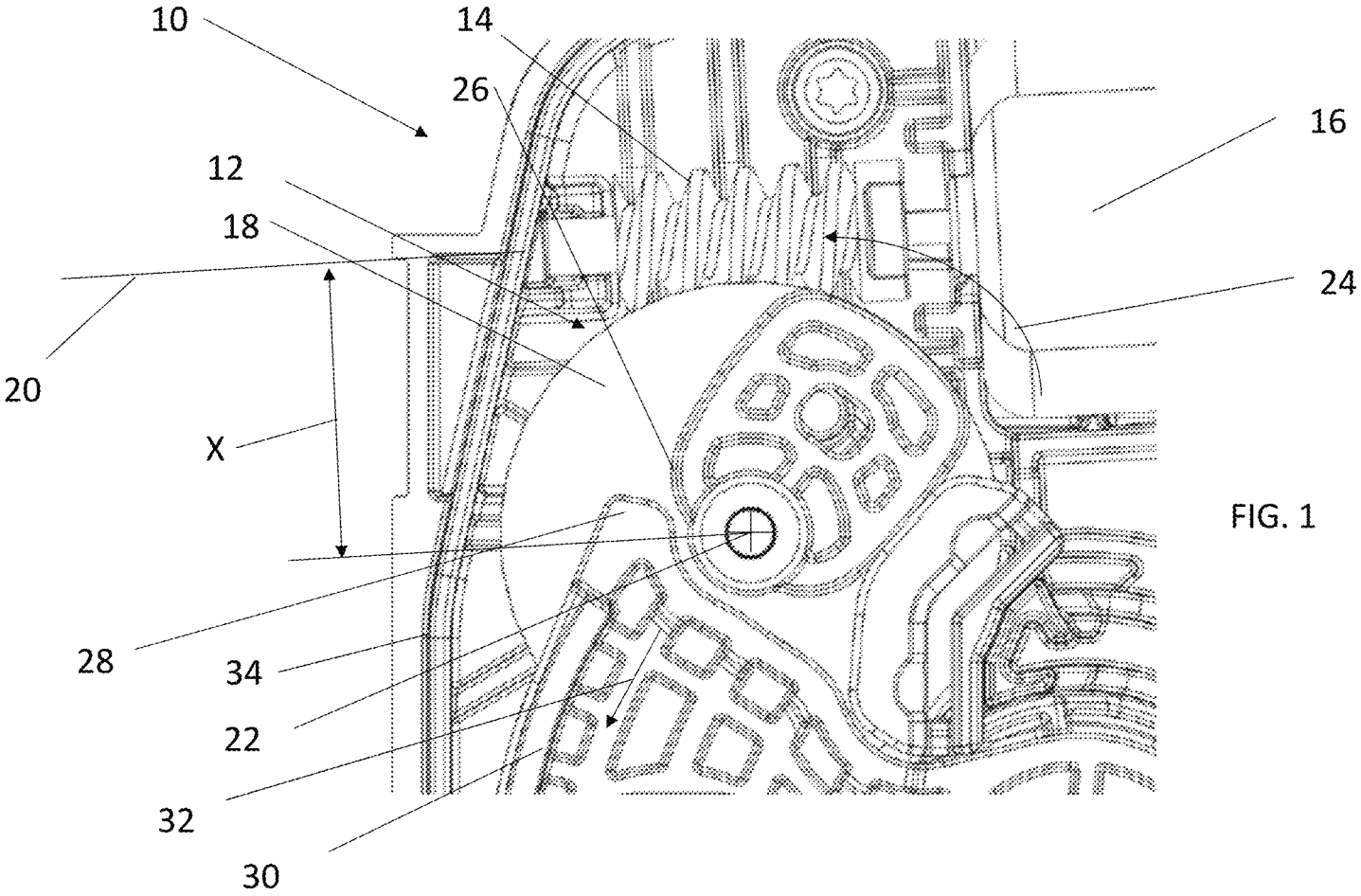
FIG. 1 illustrates a portion of a latch assembly or vehicle latch assembly in accordance with an embodiment of the present disclosure.
Figure 5:
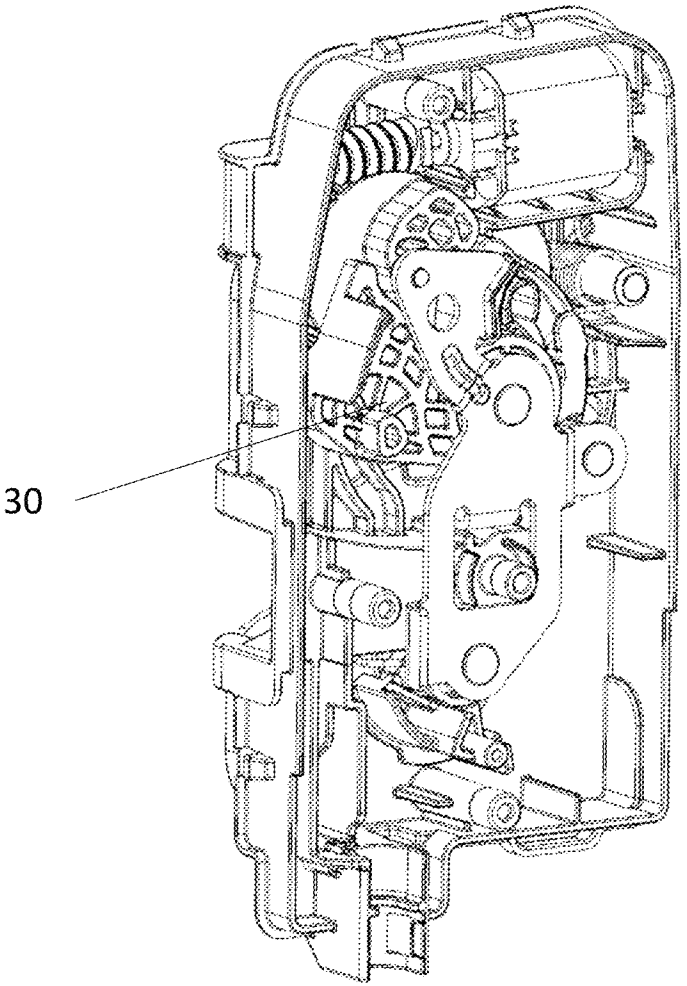
FIG. 5 is a perspective view of a latch assembly or vehicle latch assembly in accordance with an embodiment of the present disclosure with a cover removed.
Figure 6:
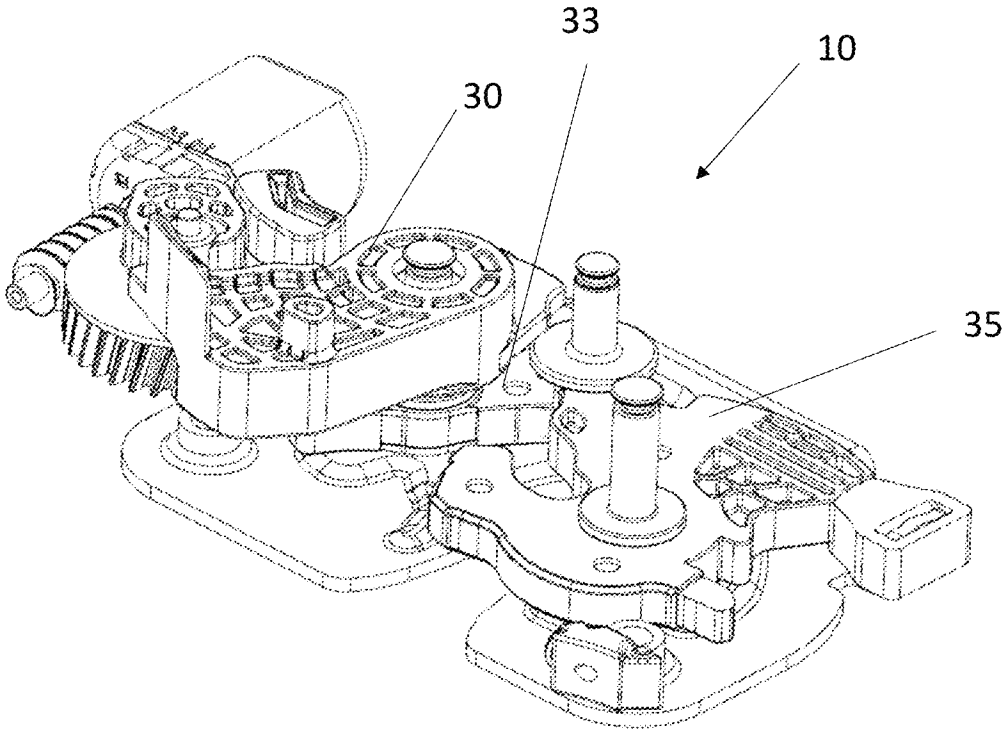
FIG. 6 is a perspective view of a portion of a latch assembly or vehicle latch assembly in accordance with an embodiment of the present disclosure.
Figure 7:
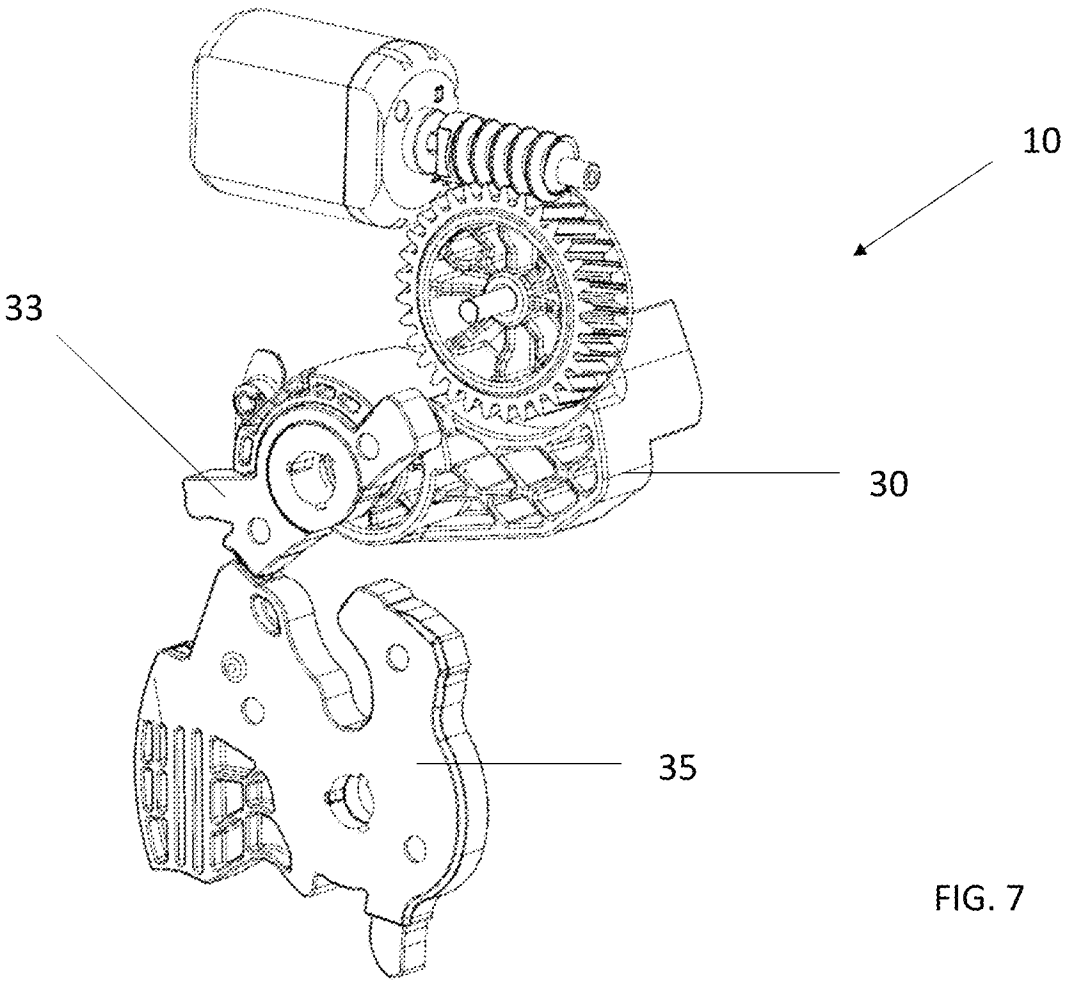
FIG. 7 is a perspective view of a portion of a latch assembly or vehicle latch assembly in accordance with an embodiment of the present disclosure.

FIG. 1 illustrates a portion of a latch assembly or vehicle latch assembly or vehicle latching assembly 10 in accordance with an embodiment of the present disclosure. The latch assembly 10 includes a gear train or a first gear train 12. The gear train or first gear train 12 includes a worm or first worm 14 operably coupled to a motor 16. When installed into the latch assembly 10, the worm or first worm 14 will meshingly engage a release gear or worm gear or first release gear 18 of the gear train or first gear train 12. Rotation of the worm or first worm 14 about axis 20 by motor 16 will cause release gear or first release gear 18 to rotate about axis 22. As the release gear or first release gear 18 rotates about axis 22 in the direction of arrow 24 a cam profile 26 of the release gear or first release gear 18 will contact a cam profile 28 of a release lever 30. This contact will cause the release lever 30 to pivot or rotate about a rotational axis of the release lever 30 such that cam profile 28 moves in the direction of arrow 32. This movement of the release lever 30 and cam profile 28 in the direction of arrow 32 will drive a pawl 33 (See FIGS. 5-7) of the latch assembly 10 which allows for a claw 35 (See FIGS. 5-7) of the latch assembly 10 to release a striker (not shown). In other words, when the release lever 30 is rotated counterclockwise, the latch assembly 10 will release and the door will open.

The axis of rotation 20 of the worm or first worm 14 is separated from the axis of rotation 22 of the release gear or first release gear 18 by a distance X. The aforementioned components: gear train or first gear train 12; worm or first worm 14; motor 16; release gear or first release gear 18; release lever 30; pawl; and claw are mounted to a housing 34 of the latch assembly 10.

The worm or first worm 14 of the gear train or first gear train 12 in FIG. 1 is a left handed 1-lead worm.

Figure 2:
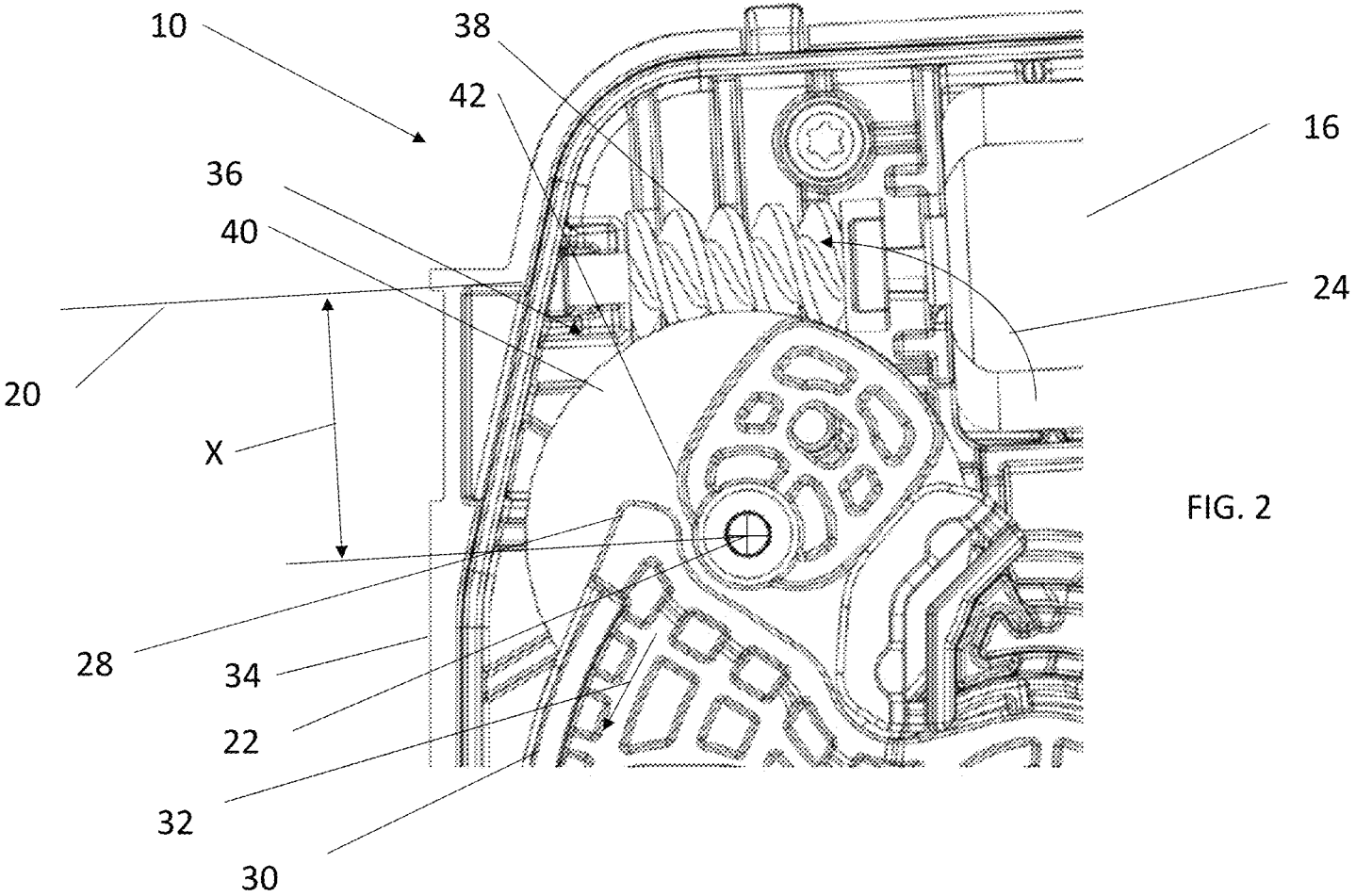
FIG. 2 illustrates a portion of a latch assembly or vehicle latch assembly in accordance with an embodiment of the present disclosure.

Referring now to FIG. 2 a portion of the latch assembly 10 in accordance with an embodiment of the present disclosure is illustrated. Here the latch assembly 10 includes a gear train or a second gear train 36. In this embodiment, all of the components of the latch assembly 10 are the same except for the gear train or second gear train 36. The gear train or second gear train 36 includes a worm or second worm 38 operably coupled to the motor 16. When installed into the latch assembly 10, the worm or second worm 38 will meshingly engage a release gear or worm gear or second release gear 40 of the gear train or second gear train 36. Rotation of the worm or second worm 40 about axis 20 by motor 16 will cause the release gear or second release gear 40 to rotate about axis 22. As the release gear or second release gear 40 rotates about axis 22 in the direction of arrow 24, a cam profile 42 of the release gear or second release gear 40 will contact the cam profile 28 of the release lever 30. This contact will cause the release lever 30 to pivot or rotate about the rotational axis of the release lever 30 such that the cam profile 28 moves in the direction of arrow 32. This movement of the release lever 30 and cam profile 28 in the direction of arrow 32 will drive a pawl (not shown) of the latch assembly 10 which allows for a claw (not shown) of the latch assembly 10 to release a striker (not shown). In other words, when the release lever 30 is rotated counter-clockwise, the latch assembly 10 will release and the door will open.

The axis of rotation 20 of the worm or second worm 38 is separated from the axis of rotation 22 of the release gear or second release gear 40 by the distance X. In other words, the distance X between the axis of rotation 20 of the worm or first worm 14 and the release gear or the second release gear 18 is the same as the distance X between the axis of rotation 20 of the worm or second worm 38 and the release gear or the second release gear 40.

As such, the first gear train 12 comprising the first worm 14 and the first release gear 18 may be interchanged with the second gear train 36 comprising the second worm 38 and the second release gear 40, while the aforementioned components: motor 16; release lever 30; pawl; and claw remain the same and are mounted to the housing 34 of the latch assembly 10.

The worm or second worm 38 of the gear train or second gear train 36 in FIG. 2 is a right handed 2-lead worm. Although the first worm 18 of the first gear train 12 is described as left handed and the second worm 38 of the second gear train 36 is described as right handed it is, of course, understood that this may be opposite (e.g., first worm right handed and second worm left handed) or any other configuration in order to ensure that there are no issues with manufacturing or assembly in order to ensure that correct worm is provided in the latch with the desired worm output (e.g., faster gear train verse slower gear train).

Figure 3:
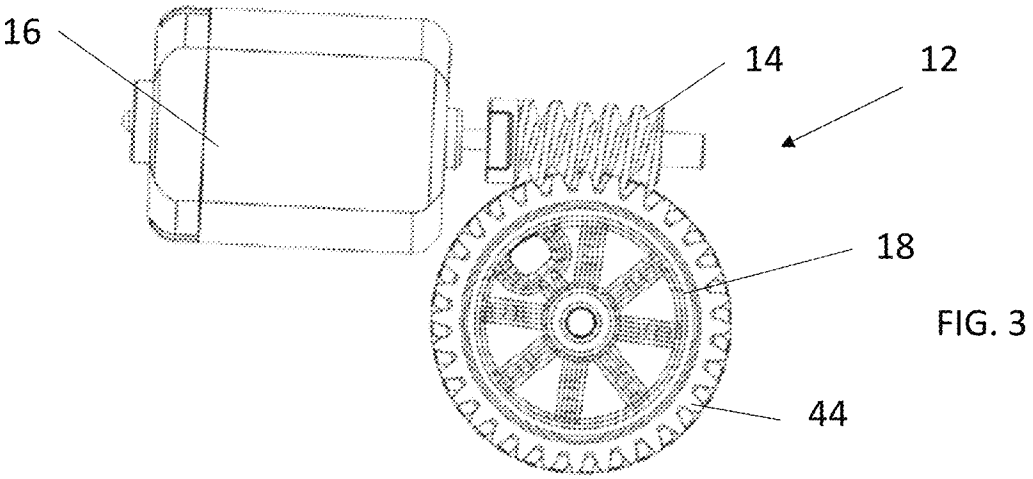
FIG. 3 illustrates the gear train of the latch assembly illustrated in FIG. 1.
Figure 4:
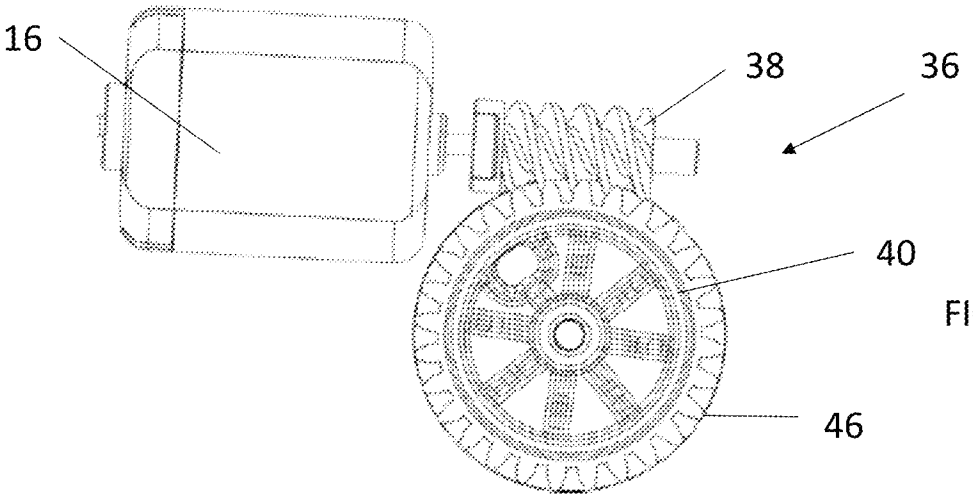
FIG. 4 illustrates the gear train of the latch assembly illustrated in FIG. 2.

FIG. 3 illustrates the worm or first worm 14 and release gear or first release gear 18 of the gear train or first gear train 12, which is a left handed 1-lead worm. FIG. 4 illustrates the worm or second worm 38 and release gear or second release gear 40 of the gear train or second gear train 36, which is a right handed 2-lead worm. The first release gear 18 and the second release gear 40 each have the same center or axis of rotation as well as the same diameter. In addition, the first worm 14 and the second worm 38 are rotated about the same axis. The first worm 14 and the second worm 38 each have different leads 1 versus 2 which mesh with complimentary teeth 44 and 46 of the respective first release gear 18 and the second release gear 40 such that the force applied by the first gear train 12 is less than the force applied by the second gear train 36 while the first gear train 12 rotates at a greater speed than the second gear train 36. As illustrated, the teeth 44 of the first release gear 18 are much closer than the teeth 46 of the second release gear 40. In other words, the first gear train 12 may actuate release lever 30 faster than the second gear train 36 while the second gear train 36 applies a greater amount of force to the release lever 30 than the first gear train 12.

As such, the interchangeability of the first gear train 12 with the second gear train 36 allows the latch assembly 10 to be converted from a front door latch, which requires less force and a quicker speed to a rear door latch that requires more force and a slower speed by only inserting or swapping the first gear train 12 with the second gear train 36. In one embodiment, the motor 16 may be part of the first gear train 12 and the second gear train 36 or the first worm 14 and the second worm 38 are removably securable to the motor 16. Although, front and rear doors are described the latch assembly with the second gear train may be applicable to any latch configured for use with a high seal load that does not employ a user operated mechanical handle to release the latch and the door or panel it is associated with.

As such, the latching assembly 10 disclosed herein is designed to allow for a more versatile and cost effective way of providing two options for electric release output and timing, while keeping the two systems as common with one another as possible. This design allows for one latch assembly design to be made, with the only variation between the two being the worm and the release gear. By fine tuning the gear trains, the two designs can be made to have a common center and approximately the same outside diameters for packaging requirements. In doing this one gear train can be designed to have very high output, while being a little bit slower, and the other can be designed for a more conventional system with balanced speed and output.

One way of achieving this is to have one of the gear trains use a 1-lead worm and the other to use a 2-lead worm. The systems will have roughly the same packaging sizes, and close to the same number of teeth, but the gear ratio on the 2-lead worm and its gear will be close to double the output of the 1-lead worm. The 1-lead worm will be close to double the speed of the other. This allows for 1 system design to be able to have two power release options without having to change any components internal to the latch other that the worm and worm gear or release gear. The release cam profile will remain common on both gears as well as stack up's and pivot size, so they are truly interchangeable.

Also, in order to ensure that there are no issues with manufacturing, the 1-lead gear train in one embodiment will be opposite handed of the 2-lead gear train, which will guarantee that they cannot be misassembled to one another.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vehicle latching assembly, comprising:

a housing;

a release lever pivotally mounted to the housing;

a first gear train for actuating the release lever when the first gear train is secured to the housing, the first gear train includes a first worm and a first release gear, wherein the first worm meshingly engages the first release gear; and a second gear train for replacing the first gear train and for actuating the release lever when the second gear train is secured to the housing, the second gear train being interchangeable with the first gear train, the second gear train includes a second worm and a second release gear, wherein the second worm meshingly engages the second release gear, wherein the second gear train applies a greater amount of force to the release lever than the first gear train, and the first worm is a left handed 1-lead worm and the second worm is a right handed 2-lead worm.

2. The vehicle latching assembly as in claim 1, wherein a diameter of the first release gear is the same as a diameter of the second release gear.

3. The vehicle latching assembly as in claim 1, wherein the first worm is configured to rotate the first release gear at a speed that is greater than a speed which the second worm is configured to rotate the second release gear.

4. The vehicle latching assembly as in claim 1, wherein the vehicle latching assembly is configured for use as a forward vehicle door latching assembly when the first gear train is located in the vehicle latching assembly.

5. The vehicle latching assembly as in claim 1, wherein the vehicle latching assembly is configured for use as a vehicle door latching assembly that does not employ a user operated mechanical handle to release the latching assembly when the second gear train is located in the vehicle latching assembly.

6. The vehicle latching assembly as in claim 1, further comprising a motor for driving the first worm or the second worm.

7. The vehicle latching assembly as in claim 1, wherein the first gear train includes a motor.

8. The vehicle latching assembly as in claim 1, wherein the second gear train includes a motor.

9. The vehicle latching assembly as in claim 1, wherein an axis of rotation of the first worm is separated from an axis of rotation of the first release gear by a distance that is equal to a distance that separates an axis of rotation of the second worm from an axis of rotation of the second release gear.

10. The vehicle latching assembly as in claim 1, wherein the first release gear and the second release gear each have a cam profile configured to contact a cam profile of the release lever.

11. A method for providing a vehicle latching assembly for either a front door or a rear door, comprising:

installing one of a first gear train or a second gear train into a housing of the vehicle latching assembly for actuating a release lever of the vehicle latching assembly, the first gear train includes a first worm and a first release gear, wherein the first worm of the first gear train meshingly engages the first release gear when the first gear train is installed in the housing, and the second gear train includes a second worm and a second release gear, wherein the second worm of the second gear train meshingly engages the second release gear when the second gear train is installed in the housing, wherein the second gear train when installed in the housing applies a greater amount of force to the release lever than the first gear train when the first gear train is installed in the housing and the first worm is a left handed 1-lead worm and the second worm is a right handed 2-lead worm.

12. The method as in claim 11, wherein a diameter of the first release gear is the same as a diameter of the second release gear.

13. The method as in claim 11, wherein the first worm is configured to rotate the first release gear at a speed that is greater than a speed which the second worm is configured to rotate the second release gear.

14. The method as in claim 11, wherein the first gear train and the second gear train includes a motor.

* * * * *